US007965244B2

(12) United States Patent
Nawa

(10) Patent No.: US 7,965,244 B2
(45) Date of Patent: Jun. 21, 2011

(54) CONNECTOR FOR CONNECTING CABLE OF HAND MICROPHONE WITH ANTENNA TO PORTABLE RADIO MACHINE BODY

(75) Inventor: Jiro Nawa, Tokyo (JP)

(73) Assignee: Temco Japan Co., Ltd. (JP)

( * ) Notice: Subject to any disclaimer, the term of this patent is extended or adjusted under 35 U.S.C. 154(b) by 390 days.

(21) Appl. No.: 12/294,060

(22) PCT Filed: Apr. 11, 2007

(86) PCT No.: PCT/JP2007/000385

§ 371 (c)(1),
(2), (4) Date: Sep. 23, 2008

(87) PCT Pub. No.: WO2007/122805

PCT Pub. Date: Nov. 1, 2007

(65) Prior Publication Data

US 2009/0128427 A1 May 21, 2009

(30) Foreign Application Priority Data

Apr. 13, 2006 (JP) ..... 2006-110885

(51) Int. Cl.
*H01Q 1/24* (2006.01)

(52) U.S. Cl. ..... 343/702; 343/906

(58) Field of Classification Search ..... 343/702, 343/906

See application file for complete search history.

(56) References Cited

U.S. PATENT DOCUMENTS

| | | | | |
|---|---|---|---|---|
| 5,038,400 | A * | 8/1991 | Baracat et al. | 455/90.3 |
| 5,524,284 | A * | 6/1996 | Marcou et al. | 455/575.7 |
| 5,959,583 | A * | 9/1999 | Funk | 343/702 |
| 6,018,321 | A * | 1/2000 | Simmons et al. | 343/702 |
| 6,758,689 | B1 * | 7/2004 | Bair et al. | 439/136 |
| 6,982,983 | B2 | 1/2006 | Ota et al. | |

FOREIGN PATENT DOCUMENTS

| | | |
|---|---|---|
| JP | 48-44871 | 12/1973 |
| JP | 136531 | 8/1987 |
| JP | 5-144526 | 6/1993 |
| JP | 9-270729 | 10/1997 |
| JP | 2004-127735 | 4/2004 |

* cited by examiner

*Primary Examiner* — Tho G Phan
(74) *Attorney, Agent, or Firm* — Schmeiser, Olsen & Watts, LLP

(57) ABSTRACT

To provide a compact and comparatively low-priced connector for a hand microphone with an antenna capable of firmly connecting to an antenna port and a UC port with high waterproofness and minimizing the attenuation of the antenna output. A connector 1 for leading an antenna output from an antenna port 4 to a hand microphone with an antenna includes an adapter 8 attached to the antenna port 4, and a connector body 7 having a swingable cap 26 engageable with the adapter 8 and a portion to be connected to the UC port 5. The adapter 8 has in its lower portion an antenna port connection terminal to be connected to the antenna port 4 and has in its upper surface a connector body connection terminal which contacts a contact pin projecting from an inner bottom surface of the swingable cap 26 and connected to the antenna of the hand microphone.

7 Claims, 7 Drawing Sheets

(Prior Art)

(Prior Art)

CONNECTOR FOR CONNECTING CABLE OF HAND MICROPHONE WITH ANTENNA TO PORTABLE RADIO MACHINE BODY

TECHNICAL FIELD

The present invention relates to a connector for connecting a cable of a hand microphone with an antenna to a portable radio body and, more particularly, to a connector for connecting a radio-frequency coaxial cable of a hand microphone with an antenna simultaneously to a UC port and an antenna port in a portable radio body.

BACKGROUND ART

As typical accessories of portable radios, a hand microphone (alias RSM (remote speaker microphone) and a hand microphone with an antenna (alias PSSM (public safety speaker microphone)) exist. Of these microphones, the PSSM is preferred for a police operation, a fire fighting operation or the like and is used in such operations. The PSSM itself necessarily has an RF transmission antenna, and there is a demand for leading an antenna output from the radio body to the PSSM without attenuating the antenna output.

In conventional portable radios, an antenna port 51 is provided in an upper surface and a UC (universal connector) port 52 for attachment of various audio accessories is provided in a side surface. This UC port 52 includes an antenna terminal 53 for the PSSM (see FIG. 8).

In the case of this arrangement, a connector of the PSSM is connected to the UC port 52 to switch the antenna output from the antenna port 51 in the upper surface to the antenna terminal 53 of the UC port 52 and lead the antenna output to the antenna of the PSSM. This output switching from the antenna port 51 in the upper surface to the antenna terminal 53 of the UC port 52 is performed, for example, by changing an internal switch by forcing in the antenna terminal 53 of the UC port 52 by means of a projection on the connector side.

The demand for PSSMs is not so strong. Under this and other conditions, recent portable radios have no antenna terminal 53 in UC ports to limit the product cost. For PSSM users, an optional component for taking an antenna output from the antenna terminal 51 in the upper surface has been devised. Such a component, however, is as high-priced as the wireless radio body and, therefore, is not generally accepted.

One at a comparatively low price, such as shown in FIG. 9, has been proposed. It has a cable supporting member 55 with an arm provided on a cable connection portion of a connector 54, and an antenna connection member 57 provided on an arm portion 56 of the cable supporting member 55. The antenna connection member 57 is screw-fixed in the antenna port 51 and includes a plurality of component parts.

The antenna connection member 57 includes a pin plug 58 screw-fixed in the antenna port 51, and a coupling member 59 provided on the arm portion 56 and connected to the pin plug 58 from just above. At the time of connection, a connection point projecting from the coupling member 59 is inserted in a socket on the pin plug 58 side.

In the case of this arrangement, the coupling member 59 is brought into engagement with the pin plug 58 from just above after attaching the connector 54 to the radio body. However, the structure for this engagement is complicated. Also, the flexibility of the cable supporting member 55 with an arm is low and it is difficult to vertically move the coupling member 59 toward the pin plug 58. Therefore, the connection operation is not easy to perform. Moreover, this arrangement entails a risk of application of excessive forces to certain portions and has the drawback of having disadvantageously low durability.

Also, there is not only a problem that the cable supporting member 55 with an arm is large and projecting upwardly so as to be obstructive, but also a problem that when something hits against this portion to pull the cable, an impact is received in a lateral direction to easily damage a portion of the pin plug 58 fixed in the antenna port 51. Also, the antenna output attenuates easily because it is taken out through the antenna connection member 57 including a plurality of component parts and soldered portions. Further, it has been pointed out that a portion of the antenna port 51 is not sufficiently waterproofed.

Patent Document 1: Japanese Patent Laid-Open No. 2001-320396

DISCLOSURE OF THE INVENTION

As described above, the connector structure for obtaining an antenna output to a PSSM, conventionally proposed is large, cumbersome, not easily operable for connection and has problems in terms of durability and waterproofness and also has a problem that the antenna output attenuates easily due to an increased number of component parts used.

The present invention has been achieved to solve the problems of the above-described conventional connector, and an object of the present invention is to provide a compact comparatively low-priced connector for connecting a cable end of a PSSM to a portable radio body, which is capable of firmly connecting to an antenna port and to a UC port with sufficiently high waterproofness by being simply operated, and which is capable of minimizing the attenuation of the antenna output by limiting the number of component parts to the least necessary number.

The invention according to claim 1 for achieving the above-described object is a connector coupled to a portable radio body by engagement between a UC port provided in a side surface of the portable radio body and an antenna port provided in an upper surface of the portable radio body to lead an antenna output from the antenna port to a hand microphone with an antenna, the connector being characterized by including an adapter attached to the antenna port, and a connector body having a swingable cap engageable with the adapter and a portion to be connected to the UC port, the connector also being characterized in that the adapter has in its lower portion an antenna port connection terminal to be connected to the antenna port, and has in its upper surface a connector body connection terminal which contacts a contact pin projecting from an inner bottom surface of the swingable cap and connected to the antenna of the hand microphone.

In a preferred embodiment, the adapter has an O-ring for watertight sealing on its intermediate portion, has a gasket on its intermediate portion, and further has at a center of its upper surface a connector body connection terminal insulated from its peripheral edge portion and flush with the peripheral edge portion.

In another preferred embodiment, the swingable cap has an arm which is axially supported on an arm supporting portion formed on an upper surface of the connector body; the adapter has a rouletted nut ring on its lower half portion, the nut ring being vertically slidable relative to the lower half portion; and a means for preventing the nut ring from coming off is provided on a lower half portion of the swingable cap.

In the connector according to the present invention, the portion connected to the adapter screwed into the antenna port is not obstructive because it is small and not largely projecting from the connector body. Also, since the portion is connected through the swingable cap, the connections to the antenna port and the UC port can be easily made and the connector does not come off easily or any of the component parts is not damaged even when the cable of the hand microphone is pulled so that an excessive force is applied to the connector coupling portion.

Also, the connector according to the present invention has adequate waterproofing means on the antenna port portion and can therefore have such waterproofness and watertightness as to temporarily withstand immersion in water. Even in the event of exposure to rain, each of the portable radio body and the hand microphone is not badly affected.

BRIEF DESCRIPTION OF THE DRAWINGS

This invention has been described in certain detail with respect to the most preferable embodiment. However, it is apparent that widely different embodiments can be formed without departing from the spirit and scope of this invention. Therefore this invention is not limited to its particular embodiments except for being limited in the appended claims.

BEST MODE FOR CARRYING OUT THE INVENTION

Figure 1:
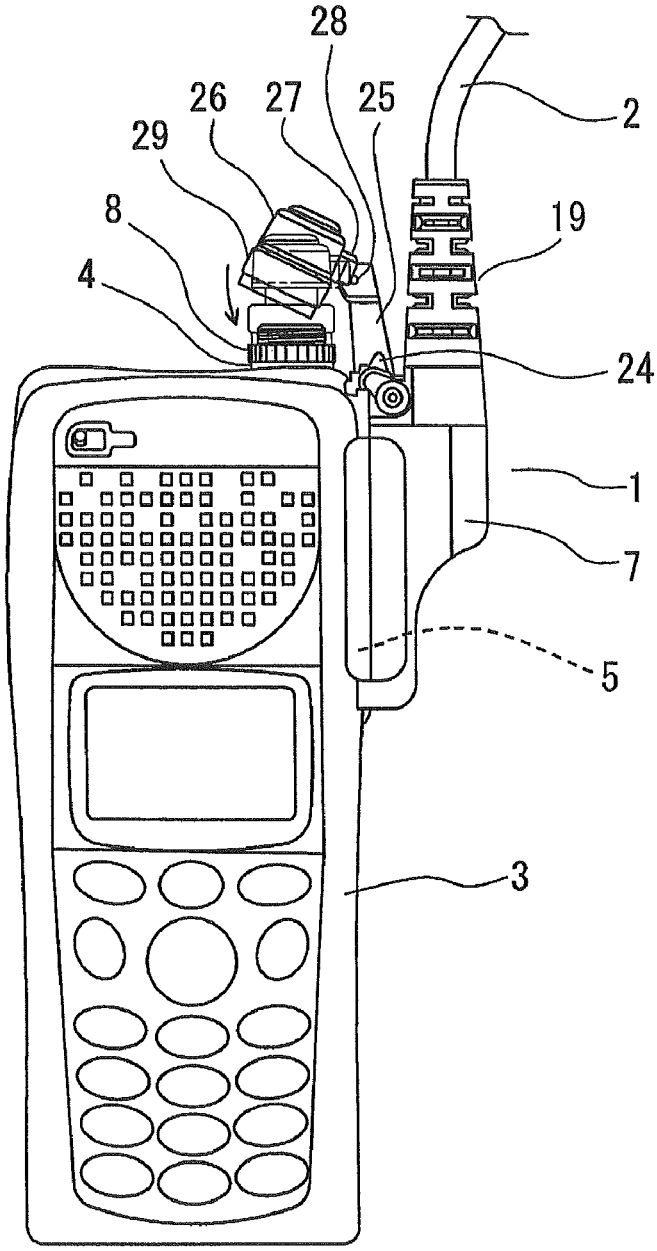
FIG. 1 is a front view of a connector according to the present invention in a state of being connected to a radio body.
Figure 2:
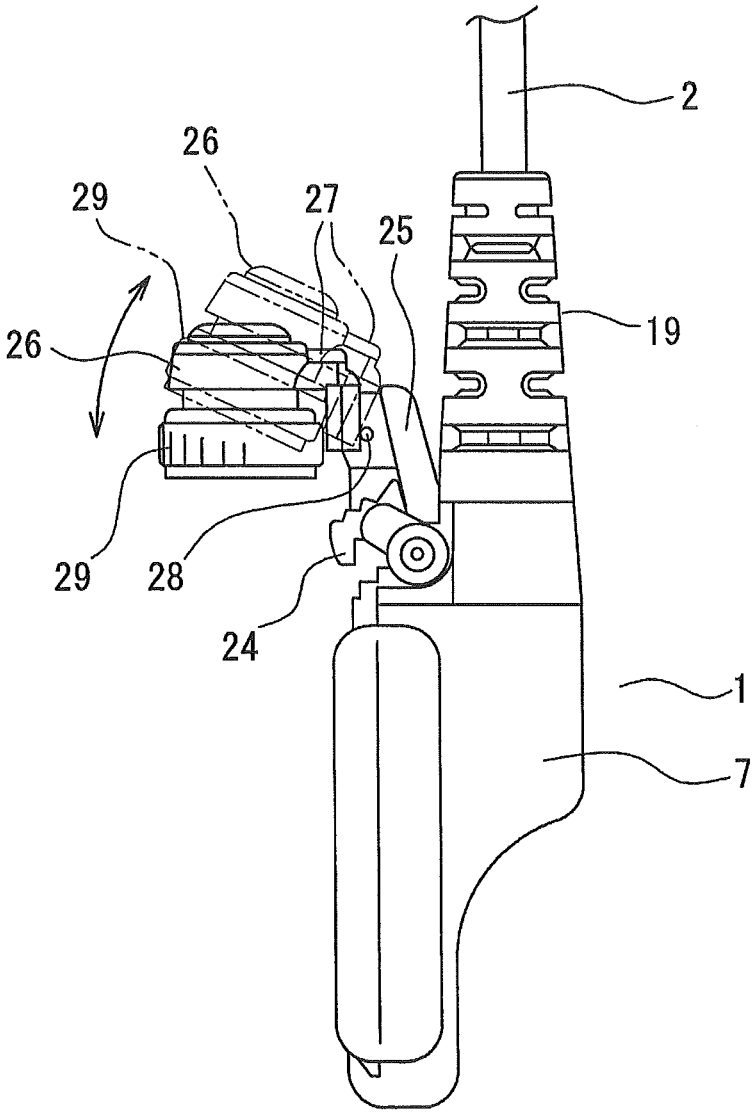
FIG. 2 is a front view of a connector body in the connector according to the present invention.
Figure 3:
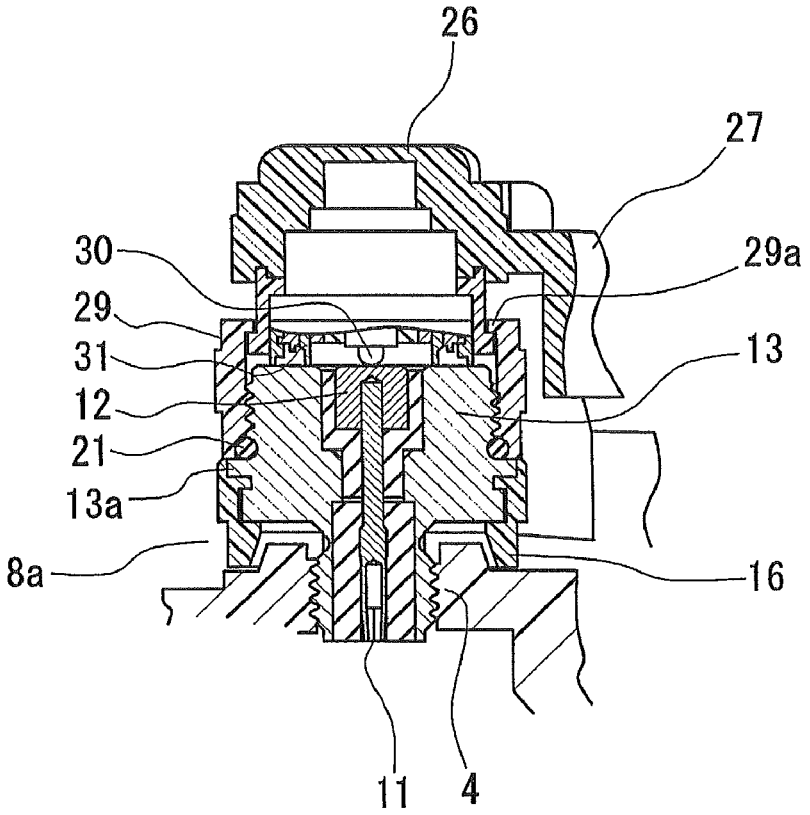
FIG. 3 is a sectional view of an essential portion in a state where the connector according to the present invention is connected to the radio body.

The best mode for carrying out the present invention will be described with reference to the accompanying drawings. A first embodiment of a connector according to the present invention will first be described with reference to FIGS. 1 to 3. FIG. 1 is a front view of a connector 1 according to the present invention in a state of being connected to a radio body 3. FIG. 2 is a front view of a connector body 7. FIG. 3 is a sectional view of an essential portion in a state where the connector 1 is connected to the radio body 3.

The connector 1 according to the present invention is for connecting a cable 2 of a hand microphone with an antenna to an antenna port 4 and a UC port 5 in the portable radio body 3. The connector 1 is constituted by the connector body 7 connected to an end portion of the cable 2 of the hand microphone and an adapter 8 or 8*a* provided separately from the connector body 7. The antenna port 4 has female threaded portion for screw-fastening an antenna.

As shown in FIGS. 3 to 7, the adapter 8 or 8*a* has an antenna port connection terminal 11 as its lower end and has a connector body connection terminal 12 as its upper end. The adapter 8 or 8*a* is connected at the antenna port connection terminal 11 side to the antenna port 4 in the radio body 3.

The specifications of the antenna port 4 in the radio body 3 vary on a model-to-model basis. It is necessary to conform the adapter 8 or 8*a* to the specifications. In ordinary cases, one of a pin plug type shown in FIGS. 4 and 5 and a socket type shown in FIGS. 6 and 7 can conform to the specifications.

Figure 4:
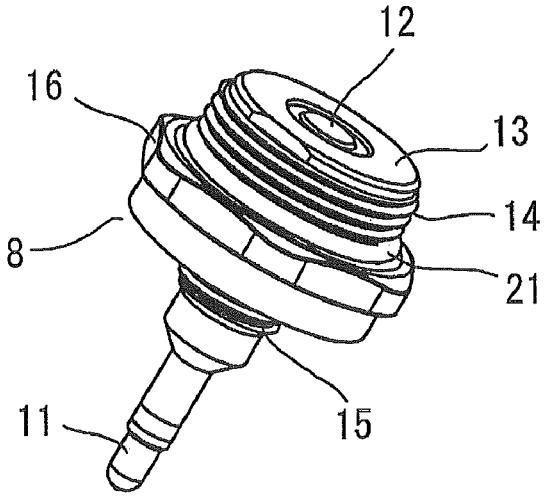
FIG. 4 is a perspective view showing an example of an adapter in the connector according to the present invention.
Figure 5:
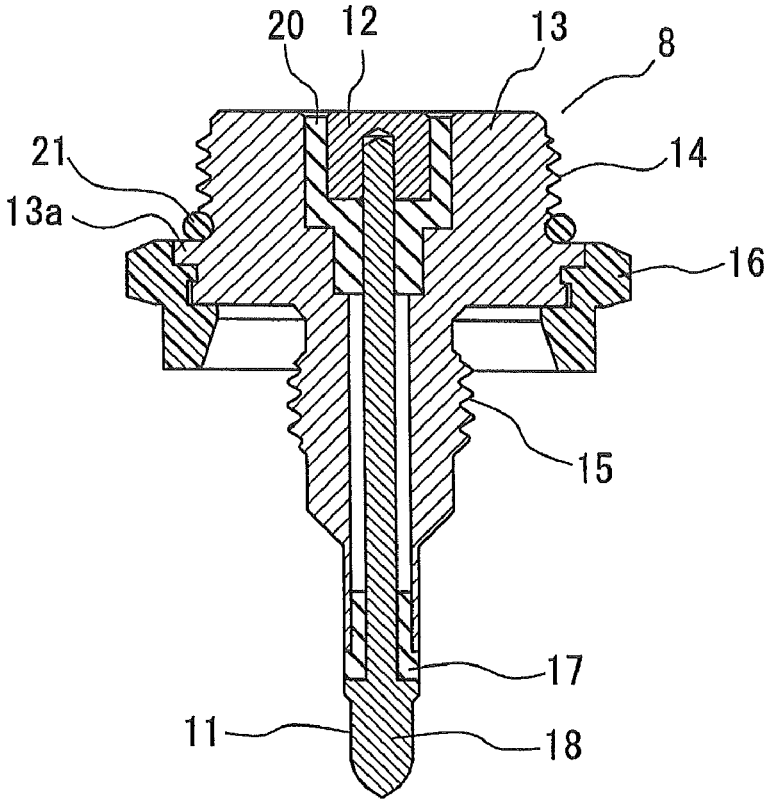
FIG. 5 is a longitudinal sectional view of the adapter shown in FIG. 4.

The pin-plug-type adapter 8 shown in FIGS. 4 and 5 is provided with a sleeve 13 having male threaded portions 14 and 15 provided on an upper-half large-diameter portion and a lower-half small-diameter portion, and a sealing ring 16 made of a resin and fitted in an intermediate portion of the sleeve 13. The upper male threaded portion 14 is for connection to the connector body 7 described below. The lower male threaded portion 15 is for fixing the adapter 8 in the antenna port 4 by screwing.

A pin 18 is inserted in the sleeve 13 from a lower end of the same, with an insulating member 17 interposed therebetween. The connector body connection terminal 12 is attached to the upper end of the pin 18, and an insulating member 20 for insulating the pin 18 and the connector body connection terminal 12 from the sleeve 13 on the earth side is fitted around the connector body connection terminal 12. Also, an O-ring 21 is placed so as to surround a lower end portion of the male threaded portion 14. The O-ring 21 is supported on a step portion 13*a* formed below the male threaded portion 14.

Figure 6:
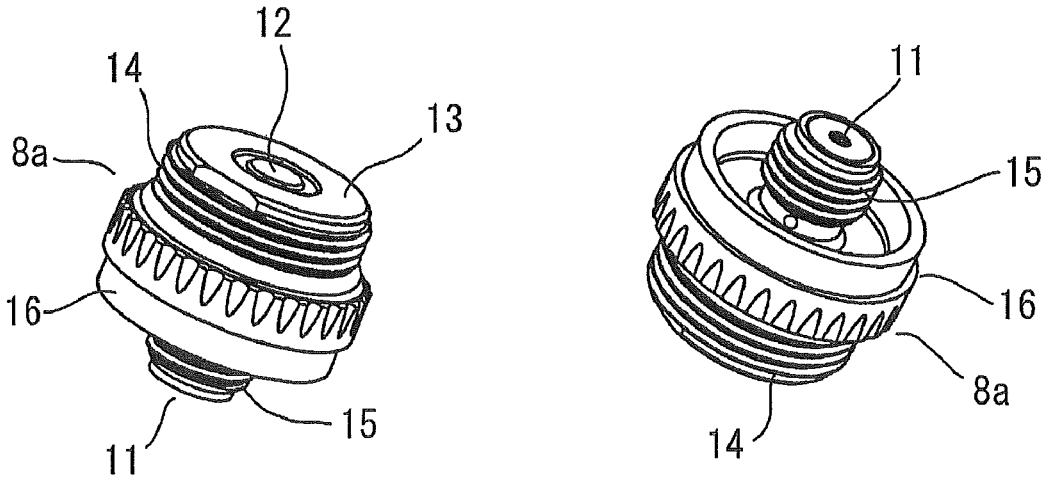
FIG. 6 comprises perspective views viewed from above and below, showing another example of the adapter in the connector according to the present invention.
Figure 7:
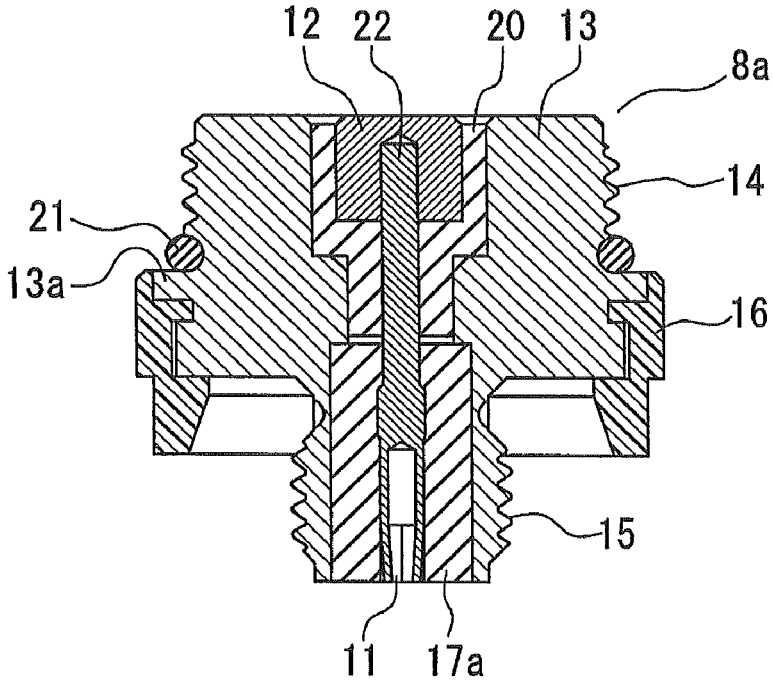
FIG. 7 is a longitudinal sectional view of the adapter shown in FIG. 6.
Figure 8:
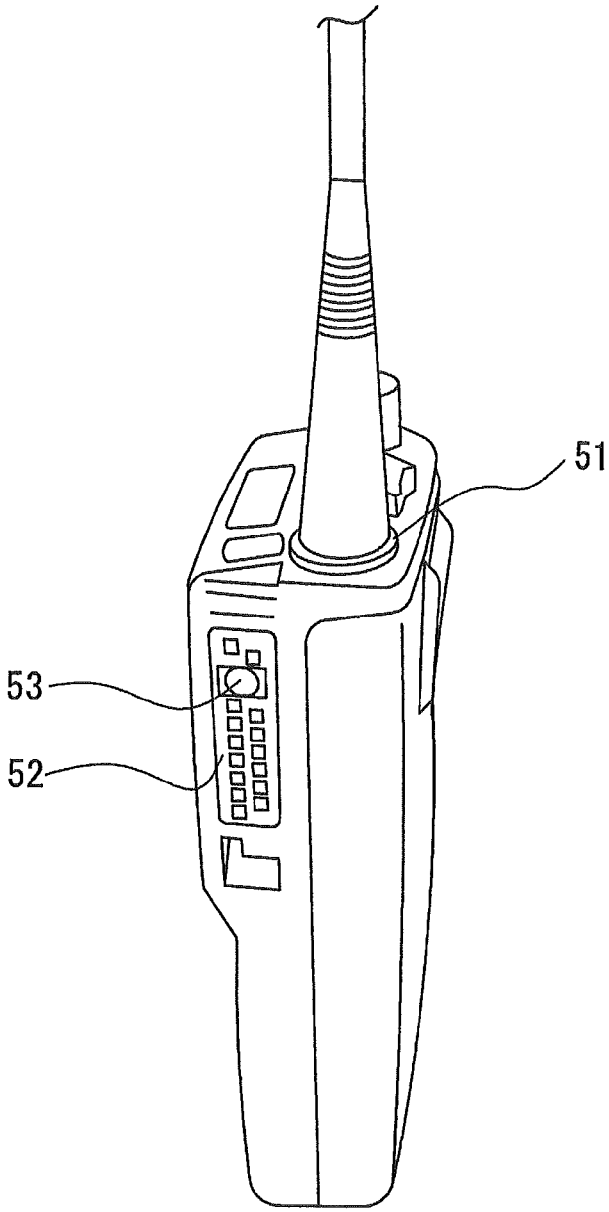
FIG. 8 is a perspective view showing an example of a portable radio having a conventional antenna terminal.
Figure 9:
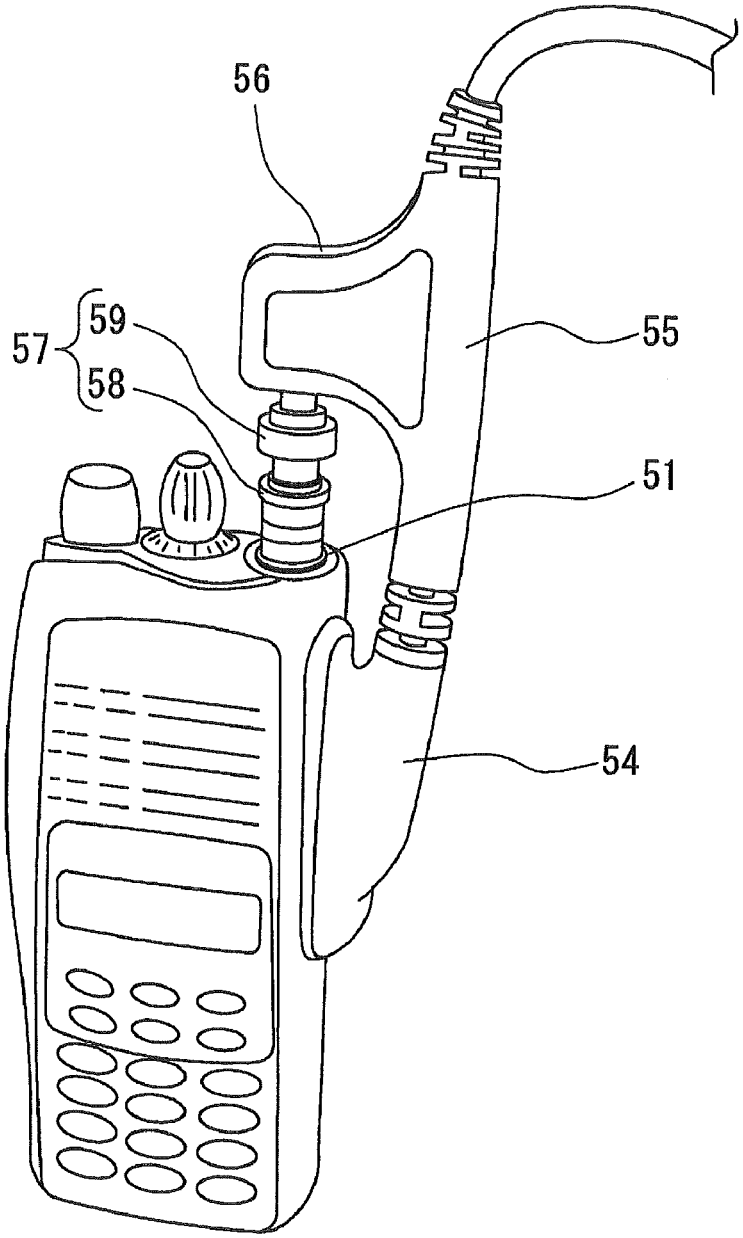
FIG. 9 is a perspective view showing an example of a connector having the function of taking an antenna output from a conventional antenna port.

The socket-type adapter 8*a* shown in FIGS. 6 and 7 is provided with a sleeve 13 having male threaded portions 14 and 15 provided on an upper-half large-diameter portion and a lower-half small-diameter portion, and a sealing ring 16 made of a resin and fitted in an intermediate portion of the sleeve 13, as is the adapter 8. The lower-half small-diameter portion of this adapter 8*a* is shorter than the lower-half small-diameter portion of this adapter 8.

A socket pin 22 covered with an insulating member 17*a* is inserted in the sleeve 13 from a lower end surface of the same. The connector body connection terminal 12 is attached to the upper end of the socket pin 22 and the insulating member 20 is fitted around the connector body connection terminal 12. Also, the O-ring 21 is placed so as to surround a lower end portion of the male threaded portion 14 while being supported on the step portion 13*a*. A connection pin (not shown) upwardly projecting in the antenna port 4 enters the socket pin 22 at the time of attachment to the antenna port 4.

The construction of the connector body 7 will next be described with references to FIGS. 1 to 3. The connector body 7 has a group of connection pins corresponding to a group of terminals in the UC port 5 and is fixed on the UC port 5 so as to cover the same. In these respects, the connector body 7 is the same as the corresponding conventional one. Several methods are conceivable as a method for fixing the connector body 7 in correspondence with those for the conventional one.

In the illustrated fixing method, a non-illustrated engaging portion provided on a lower portion of the connector body 7 is caught on a non-illustrated projecting portion provided on the UC port 5, and a hook of a turning lock means 24 provided on an upper portion of the connector body 7 is thereafter caught on a recessed portion provided on an upper surface corner portion of the radio body 3. Screw-fastening may further be performed in this state.

A cable supporting portion 19 is provided on an upper surface of the connector body 7. An arm supporting portion 25 also projects from the upper surface of the connector body 7. An arm 27 of a swingable cap 26 is turnably mounted by a shaft 28 on the arm supporting portion 25.

In the swingable cap 26, a lead wire connected to the cable 2 is led in through the arm supporting portion 25, and a contact pin 30 connected to the lead wire is disposed so as to be capable of moving outward and inward in an inner bottom surface of the swingable cap 26 while being urged by a non-illustrated spring. Also, a cylindrical terminal 31 provided so as to surround the contact pin 30 while being insulated from the same is disposed so as to be capable of moving outward and inward in the inner bottom surface of the swingable cap 26 while being urged by a non-illustrated spring. The contact pin 30 contacts an upper surface of the connector body connection terminal 12 of the adapter 8 or 8*a*, and the cylindrical terminal 31 contacts an upper surface of the sleeve 13 on the earth side.

A rouletted nut ring 29 is attached to a lower half portion of the swingable cap 26 so as to be vertically slidable relative to the lower half portion of the swingable cap 26. The nut ring 29 has an inwardly-extending flange at its upper end. This flange is engaged with an outwardly-extending flange provided on the lower end of the swingable cap 26 to prevent the nut ring 29 from coming off the swingable cap 26 (see FIG. 3).

When the connector constructed as described above is attached to the radio body 3, the adapter 8 or 8*a* is first fixed by being screwed into the antenna port 4 of the radio body 3. Next, the connector body 7 is fixed on the UC port 5 by a means such as turning lock means 24.

In the state where the connector body 7 is fixed on the UC port 5, the swingable cap 26 is positioned just above the adapter 8 or 8*a* in a state of being vertically swingable. The nut ring 29 of the swingable cap 26 is then drawn downward while being held by its rouletted portion to be put on the adapter 8 or 8*a* and is screwed around the adapter 8 or 8*a* in this state. This operation can be performed easily and speedily because the nut ring 29 is vertically movable relative to the swingable cap 26, and because the swingable cap 26 itself is swingable.

The nut ring 29 is fastened in this way to complete the attachment of the connector. Since the swingable cap 26 is swingable in particular, no excessive forces are applied to fastened portions. Also, since coupling between the connector body 7 and the adapter 8 or 8*a* is performed through the swingable cap 26, the coupling portion can be compactly constructed so as not to be obstructive.

In this attached state, the nut ring 29 strongly presses the O-ring 21 of the adapter 8 or 8*a*. Therefore, sufficiently high watertightness at the corresponding portion is ensured. Also, the adapter 8 or 8*a* is fastened to the antenna port 4 to maintain a gasket 16 in close contact with a peripheral edge of the antenna port 4 to ensure a degree of watertightness for enabling temporarily withstanding immersion in water.

The invention claimed is:

1. A connector coupled to a portable radio body by engagement between a UC port provided in a side surface of the portable radio body and an antenna port provided in an upper surface of the portable radio body to lead an antenna output from the antenna port to a hand microphone with an antenna, the connector being characterized by comprising an adapter attached to the antenna port, and a connector body having a swingable cap engageable with the adapter and a portion to be connected to the UC port, the connector also being characterized in that the adapter has in its lower portion an antenna port connection terminal to be connected to the antenna port, and has in its upper surface a connector body connection terminal which contacts a contact pin projecting from an inner bottom surface of the swingable cap and connected to the antenna of the hand microphone.

2. The connector according to claim 1, wherein the adapter has an O-ring for watertight sealing on its intermediate portion.

3. The connector according to claim 1, wherein the adapter has a gasket on its intermediate portion.

4. The connector according to claim 1, wherein the adapter has at a center of its upper surface a connector body connection terminal insulated from its peripheral edge portion and flush with the peripheral edge portion.

5. The connector according to claim 1, wherein the swingable cap has an arm which is axially supported on an arm supporting portion formed on an upper surface of the connector body.

6. The connector according to claim 1, wherein the adapter has a rouletted nut ring on its lower half portion, and the nut ring is vertically slidable relative to the lower half portion.

7. The connector according to claim 6, wherein a means for preventing the nut ring from coming off is provided on a lower half portion of the swingable cap.

* * * * *